US006606370B1

(12) United States Patent
Kasprowicz

(10) Patent No.: US 6,606,370 B1
(45) Date of Patent: Aug. 12, 2003

(54) SYSTEM FOR THE STORAGE AND TRANSPORTATION OF ANTI-MATTER

(76) Inventor: Lukas Kasprowicz, Seldeneckstrasse 42, D-76185 Karlsruhe (DE)

( * ) Notice: Subject to any disclaimer, the term of this patent is extended or adjusted under 35 U.S.C. 154(b) by 0 days.

(21) Appl. No.: 09/618,308

(22) Filed: Jul. 18, 2000

(30) Foreign Application Priority Data

Jul. 19, 1999 (DE) ..... 199 33 131

(51) Int. Cl.[7] ..... G21C 13/00

(52) U.S. Cl. ..... 376/913; 376/113

(58) Field of Search ..... 376/107, 113, 376/913

(56) References Cited

U.S. PATENT DOCUMENTS

| | | | | | |
|---|---|---|---|---|---|
| 4,654,561 | A | * | 3/1987 | Shelton | 315/111.71 |
| 4,867,939 | A | * | 9/1989 | Deutch | 376/156 |
| 5,773,919 | A | * | 6/1998 | Seward | 313/231.31 |
| 5,818,891 | A | * | 10/1998 | Rayburn et al. | 376/107 |
| 5,977,554 | A | * | 11/1999 | Smith et al. | 376/127 |

OTHER PUBLICATIONS

Curt Suplee; The Washington Post; Taming Anti–Atoms; 2 pages; May 13, 1996.*

Article derived from the web on "Antimatter Space Propulsion at Penn University (LEPS)", publication date Jun. 21, 1999, 2 pages with cover sheet.

Article derived from the web on "Advanced Propulsion Concepts" for Portable Antiproton Penning Trap., 6 pages, no date.

* cited by examiner

*Primary Examiner*—Stephen M. Johnson
(74) *Attorney, Agent, or Firm*—Ostrolenk, Faber, Gerb & Soffen, LLP

(57) ABSTRACT

According to the invention, anti-matter can be stored in a spherical shell container (10) and is introduced into or extracted from the latter by being loaded in an attached piece (42) adjoining an.opening in the container from the exterior of the sphere into its interior, and this always taking place without touching the container wall and attached piece, which consist of matter. In accordance with a particularly preferred exemplary embodiment; spherical shell segments (18) generate in the interior of the sphere an electrostatic field which keeps electrically charged anti-matter in a stable position in a fashion centered about the center of the sphere of the storage system.

12 Claims, 5 Drawing Sheets

SYSTEM FOR THE STORAGE AND TRANSPORTATION OF ANTI-MATTER

BACKGROUND OF THE INVENTION

PRIOR ART

The present invention relates to a system for the storage and transportation of anti-matter and to a method for filling or emptying a storage container for anti-matter with the aid of the same.

So-called anti-matter has virtually everything in common with matter, specifically mass, energy, its behavior when it is exposed to electric or magnetic or gravitational fields, the presence of electric charges, but not the polarity of the so-called elementary charge. A piece of anti-matter which corresponds approximately to an electron would therefore not, for example, have a negative elementary charge, but a positive elementary charge. Thus, for example, hydrogen has a proton as nucleus and an electron in its electron shell, whereas so-called anti-hydrogen has an anti-proton in its nucleus, which has a negative electric charge, and has around this a so-called positron, which has a positive elementary charge, instead of the electron. In the case of heavier elements than hydrogen, this system is continued, and the nuclei of molecules are therefore always negatively charged and the so-called "positron shells", that is to say the positively charged shells which correspond to the electron shell in the case of matter, are positively charged.

The detection of small quantities of anti-matter, that is to say a few countable elementary particles, is based on their ability to be deflected by electric or magnetic forces. If anti-matter is neither electrically charged, that is to say is electrically neutral, nor can be attracted or repelled by a magnetic field, that is to say is magnetically neutral, it can be handled only with difficulty on Earth or in space in regions where matter prevails, since it is very quickly neutralized by material particles colliding with it, and is thereafter no longer present.

The present invention therefore relates, in particular, to anti-matter which is either electrically charged or is not magnetically neutral.

An anti-proton and a positron were first combined to form so-called anti-hydrogen in 1995. Production thereof requires the exact cooperation of a plurality of accelerators such as, for example, the CERN accelerators. Firstly, protons are accelerated in linear accelerators, boosters and proton synchrotrons (PS) to 27 GeV.

These protons strike a heavy target. Many particle/anti-particle pairs are produced in the collision of the protons with the target nuclei, including proton/anti-proton pairs in specific cases. Some of the anti-protons are captured in an anti-proton cooler (AC) and stored in the anti-proton accumulator. From there, they are fed from time to time into the low-energy anti-proton ring (LEAR) where they are available for experiments.

A different avenue is taken for producing anti-matter in-the PS210 experiment of the CERN accelerator: when an anti-proton circulating in the accelerator passes very closely by a so-called target nucleus, for example the element xenon, electron-positron pairs are produced "from time to time". If an anti-proton captures a positron, which very seldom happens, anti-hydrogen is produced.

Progress in the production of anti-matter is prompting the creation of systems which can store this anti-matter. A further cause of the necessity of such systems is the fact that the existence of anti-matter in space is presumed. Of course, there is the need to capture such anti-matter from space in order to be able to analyze it scientifically, or keep it ready for other purposes. Thus, the US shuttle Discovery could, inter alia, be searching for anti-matter in space on its flight planned for the beginning of June 1998. An on-board alpha magnet spectrometer (AMS) can carry out appropriate measurements to detect anti-matter. This instrument can, inter alia, detect anti-helium and anti-carbon nuclei if these particles are electrically charged. The detection method is based on the deflection of moving, electric charges in a magnetic field.

It is clear from the foregoing description that systems for the storage and transportation of anti-matter will possibly be required in the near future. It follows from a NASA Internet publication of May, June 1999 at http://members.inic.com/amiga/monats-thema-april99.html that such a storage system has a tubular structure whose lateral surface is formed by a magnet having an inlet opening and an outlet opening, in each case on the top surface or bottom surface of the cylinder.

The crucial problem that has to be solved in the storage of anti-matter consists in the anti-matter being kept in the interior of the container irrespective of whatever state it may be present in, for example electrically charged or electrically neutral or ferromagnetically or magnetically neutral, without coming into contact with the material of the wall of the container. Such a contact would otherwise immediately convert the anti-matter into matter, in which case large quantities of energy would be released with the attendant risk in principle of destroying the container in the process.

A further important boundary condition for the storage and transportation of anti-matter in such a container is that the interior of the container is evacuated in an extreme way in order to prevent reactions of the anti-matter with air constituents present in the interior of the container.

The anti-matter accommodated in the NASA storage system is distributed in a rotationally symmetrical fashion about the cylinder axis in the desired state. The anti-matter is kept on this axis in a more or less stable state by the magnetic field, whose field strength distribution can be electronically controlled.

A disadvantage of this storage system is that the anti-matter can be displaced in the longitudinal direction relative to the top surface or bottom surface of the cylinder. This can have a disadvantageous effect when the container is, for example, subjected to specific, unforeseen accelerations during transportation.

The risk exists in this case of the anti-matter being displaced along the central axis and reacting with the matter of the top surface or base surface and being destroyed in the process.

SUMMARY OF THE INVENTION

One object of the present invention consists in creating a container for anti-matter which is designed such that the position of the anti-matter in its interior does not change even when the above-mentioned accelerations occur.

In accordance with another aspect, a further object of the present invention consists in designing the proposed container in such a way that it manages essentially without a magnetic field.

A further object consists in filling or emptying the proposed container.

ADVANTAGES OF THE INVENTION

The said objects of the invention are achieved by means of the features named in the attached claims. Advantageous developments representing the further aspect of the invention follow from the respective subclaims.

The basic idea of the invention consists in creating a spherically symmetrical arrangement instead of the cylindrical geometry proposed by NASA, although in this case it is immediately evident to the person skilled in the art that an arrangement for filling such a sphere disturbs the spherical symmetry of the force field present in the interior.

This difficulty is solved by an arrangement, proposed according to the invention, of closable openings in the spherical shell.

In accordance with a first exemplary embodiment, it is proposed according to the invention to construct a highly evacuable spherical container for the storage of anti-matter, which is hollow on the inside and whose spherical shell is assembled from individual segments which contribute to the generation of a force field in the interior of the sphere. In a particularly preferred way, the segments are juxtaposed in a tiling fashion so that irregularities on the inner wall of the sphere are as slight as possible.

In accordance with one exemplary embodiment of the present invention, the spherical shell segments generate a magnetic field which keeps electrically charged or magnetic anti-particles in the center of the sphere.

In accordance with a further, particularly preferred exemplary embodiment, the spherical shell segments generate in the interior of the sphere an electrostatic field which keeps electrically charged anti-matter in a stable position in a fashion centered about the center of the sphere. This is attended by the particular advantage that the control of the spherical shell segments is much less complicated, since a stable equilibrium is achieved per se when the electric polarity of the spherical wall is the same as the polarity of the anti-matter stored in the interior of the sphere. The repulsive forces generated by the respective charges have the effect that the anti-matter is kept stably in the interior of the sphere.

The openings according to the invention for filling or emptying the spherical container are defined in that their geometry and arrangement and the geometry and arrangement of closing parts for the openings are such that they are matched to the force field of the spherical shell and permit an unstable or stable equilibrium of the anti-matter as continuously as possible during the filling or emptying into or out of the spherical container.

An essential characteristic of the arrangement of the closing parts consists in that during filling they can be kept equidistant from one another and, keeping the anti-matter between them, can be introduced from outside through the spherical shell into the interior of the shell through a first opening, and can be brought into a stable final position in which the sphere is closed and the force field is uniform enough to keep the anti-matter in the interior of the sphere.

BRIEF DESCRIPTION OF THE DRAWINGS

Preferred exemplary embodiments of the invention are illustrated in the drawings by way of example and explained in more detail in the following description.

In a sectional illustration in each case, in the drawing.

DESCRIPTION OF THE EXEMPLARY EMBODIMENTS

Figure 1:
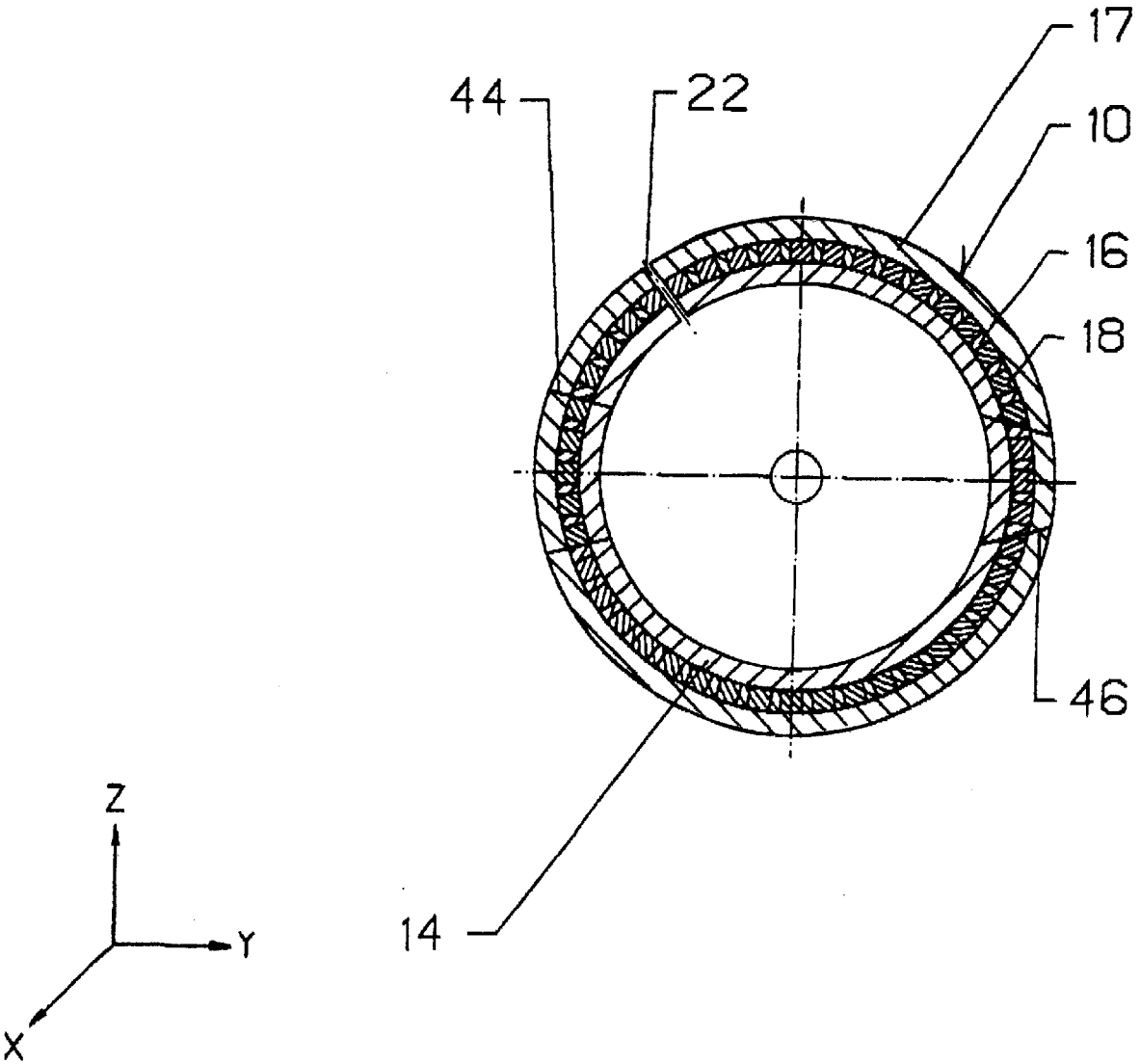
FIG. 1 shows the spherical container in an embodiment-in which a magnetic field acts as force field.

The basic design of the spherical container and of its shell are described with general reference to the drawings and particular reference to FIG. 1.

The spherical container is denoted as a whole by the reference symbol 10. It has a spherical shell 12 with a preferably uniform thickness D. The spherical shell consists of a plurality of layers in the radial direction. The innermost layer 14 is a layer made from a material which emits as few particles as possible in a temperature range as wide as possible. Furthermore, the inner layer must allow the force field generated by a second spherical shell layer to pass into the cavity of the interior of the sphere. In the exemplary embodiment shown, a second layer 16, the so-called magnetic layer, generates a magnetic field in the interior of the sphere which is designed such that anti-matter, if it is magnetically or electrically charged, is kept in the interior of the sphere without coming into contact with the wall.

The second layer is expediently built up from individual, juxtaposed spherical shell segments 18 which are electrically controlled individually or in groups of suitable number by a central control device which ensures, for its part, that the field in the interior is uniform.

The ferromagnetic anti-matter, for example anti-iron, is then uniformly attracted by the magnets in the envelope of the sphere. This produces at the center of the sphere and around a spherically symmetrical center domain a site for the anti-matter at which it can be kept in a state of equilibrium by suitable open-loop and/or closed-loop control operations, so that it does not come into contact with matter.

Viewed in the radial direction, the individual magnets filling a spherical shell segment 18 are always identically polarized, for example the south pole can always be directed into the middle.

Also provided is an evacuation opening 22 which radially penetrates the spherical shell and is connected to a corresponding vacuum generator.

An outer layer 17 of the spherical shell consists of a material which is matched to the location and application of the storage container. Depending on the requirements made, this could, for example, be ceramic, in order to withstand high temperatures and offer only low heat conductivity toward the inside, or else it could also be a high-grade steel in order to ensure high mechanical loadability. Further exemplary embodiments of the materials for the outer layer can be put together in a corresponding way.

Layers 14, 16, 17 are secured against mutual rotation by suitable projections and indentations in which these projections engage mechanically. However, it is also possible to use other anti-rotation means, depending on the material of the layers and the current application of the container.

Electrically charged anti-matter is likewise kept in the center of the sphere by the magnetic field.

Figure 2:
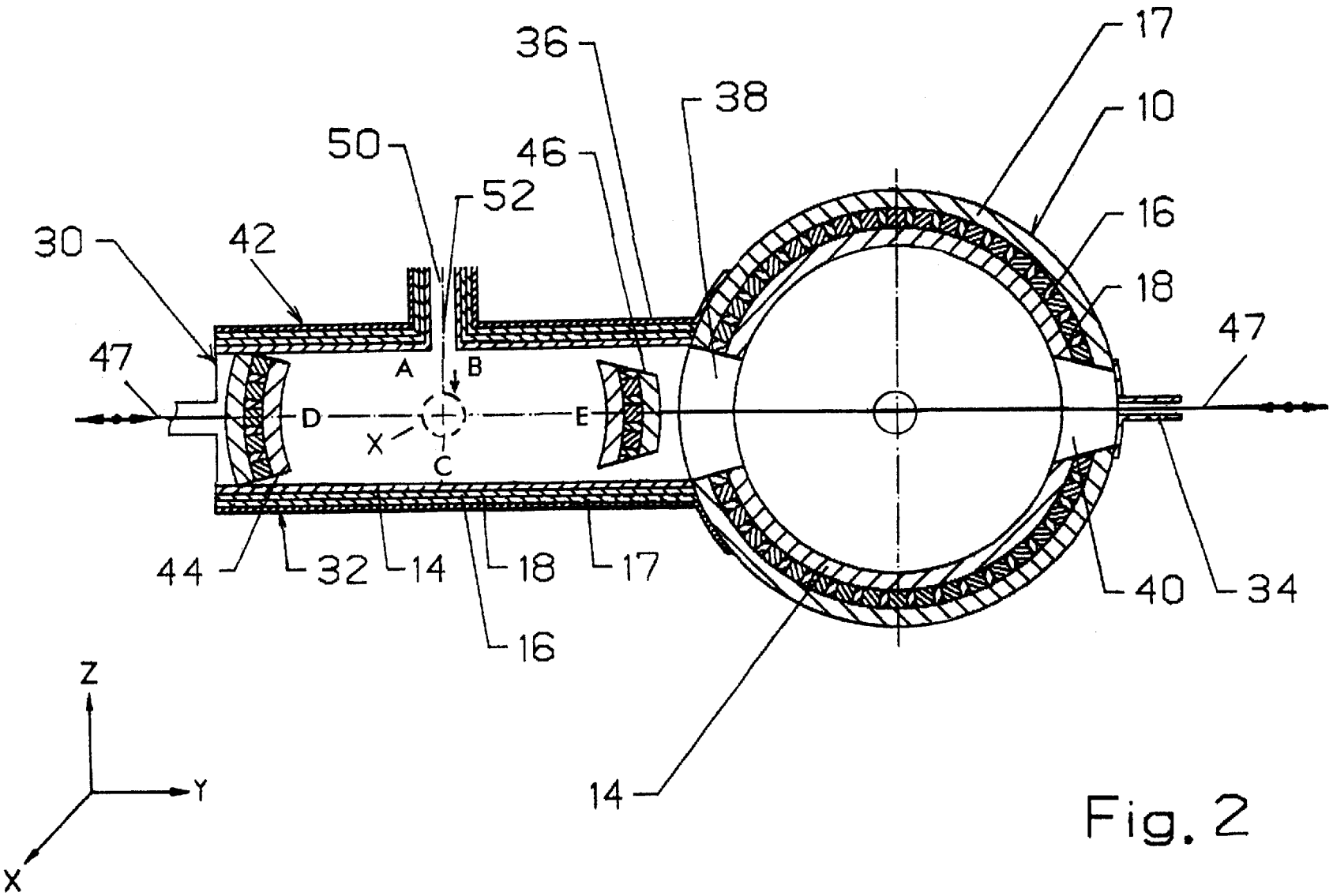
FIG. 2 shows the spherical container of FIG. 1 with a filling and emptying arrangement connected thereto, the closing pieces being in the extended state.

With reference to FIG. 2, a further exemplary embodiment of the present invention will now be explained which can be used in conjunction with the spherical shell illustrated in FIG. 1 and a magnetic field in the interior of the sphere, but is likewise the subject matter for a particularly preferred exemplary embodiment in which electrically charged anti-matter is kept in the interior of the sphere by an electrostatic field. This latter embodiment is treated further below.

In accordance with FIG. 2, the spherical container 10 is provided with a filling and emptying device which docks on the right-hand side in FIG. 2 or the left-hand side on the spherical container 10. The filling and emptying device is provided as a whole with the reference symbol 30. It comprises a continuous frame 32 which mechanically connects the part 34 illustrated on the right in the figure with the part 36 illustrated on the left in the figure. The prime task of the frame is to lend the arrangement 30 an appropriate mechanical stability, and to ensure that the arrangement 30 can be guided stably in a fashion suiting the openings located in the spherical shell, specifically a first, larger opening 38 and a second, smaller opening 40.

The left-hand region 36 of the filling and emptying arrangement is formed by a cylindrical attachment 42. On the side directed toward the spherical shell, it has an opening which surrounds the first, larger opening 38 in the spherical shell, such that when properly used the opening cross section of the latter is preferably not reduced by the attachment 42. Arranged in the interior of the attachment 42 are two closing pieces, a first closing piece 44, which fits the larger opening 38 in the spherical shell, and a second closing piece 46, which fits the second, smaller opening 40 in the spherical shell.

Like the remainder of the spherical shell, the closing pieces 44 and 46 comprise the above-described spherical shell segments.

Starting from their convex outer surfaces, both closing pieces are coupled by means of a rigid connection, a rigid frame rod 47 which can absorb tensile and thrust forces in the direction of the illustrated longitudinal axis of the cylindrical attachment, and which ensures that the closing pieces can move as pairs with the same distance between them when a force is-exerted on one of the two closing pieces. This movement is then guided by the rigid coupling in such a way that it extends exactly in the axial direction through the center of the sphere and along the axis of the cylindrical attachment 42.

By means of a drive represented only diagrammatically in the illustration, the two closing pieces can be moved along the central axis of the cylindrical attachment 42 out of the position illustrated in FIG. 2 and through the opening 38, and be guided further in this direction until the closing piece 46 fits in the opening 40 and, at the same time, the closing piece 44 fits in the opening 38.

The lateral surface of the cylindrical attachment 42 has an inner layer structure which is similar to that of the spherical shell, in order likewise to be able to exert forces of magnetic attraction on the anti-matter in the interior thereof. The same reference symbols therefore apply here.

Also located in the lateral surface of the cylindrical attachment is an introduction channel for anti-matter, which is re-machined in the manner of the design, mentioned in the introduction to the description, of the tubular storage container for anti-matter described by NASA.

Reference is therefore made to the above-mentioned publication for further details on this introduction channel. The introduction channel opens into the cylindrical attachment 42 through an opening 52.

The filling of the spherical container 10 with anti-matter which is ferromagnetic, that is to say, for example, anti-iron, is described below with reference to FIG. 2.

The anti-matter passes through the introduction channel 50 into the interior of the cylindrical attachment 42. In order to control its position and movement in such a way that it does not come into contact with any wall bordering on the interior of the attachment 42 or of the shell 10, its movement is controlled by essentially three arrangements A, B and C which each generate a magnetic field which permits the above-described movement of the anti-matter. A and B are located on mutually opposite sides of the introduction channel and generate magnetic fields which are directed upstream. The direction of flow is illustrated in FIG. 2 by an arrow. A and B serve to brake the movement of the anti-matter.

The movement of the matter in the direction of flow is rendered possible by a magnetic field C which is arranged opposite the introduction opening 52, and by corresponding magnets in the wall region, at that location, of the cylindrical attachment 42. Depending on the speed of the anti-matter, the polarity of C can be reduced, or even inverted. It is therefore possible to prevent the anti-matter from impinging in the region of the wall in which the magnetic field C is generated.

The anti-matter is now located as a certain, prescribed quantity in a spherical mass X at the point of intersection between the axis of the introduction channel 50 and that of the cylindrical attachment 42. The introduction channel is now closed. An appropriate device is provided for this purpose. How the anti-matter reaches into the interior of the sphere will be described below. The direction of magnetization of the magnets contained in the closing pieces 44 and 46 can be controlled starting from their polarity and from the strength of the magnetic field.

Figure 3:
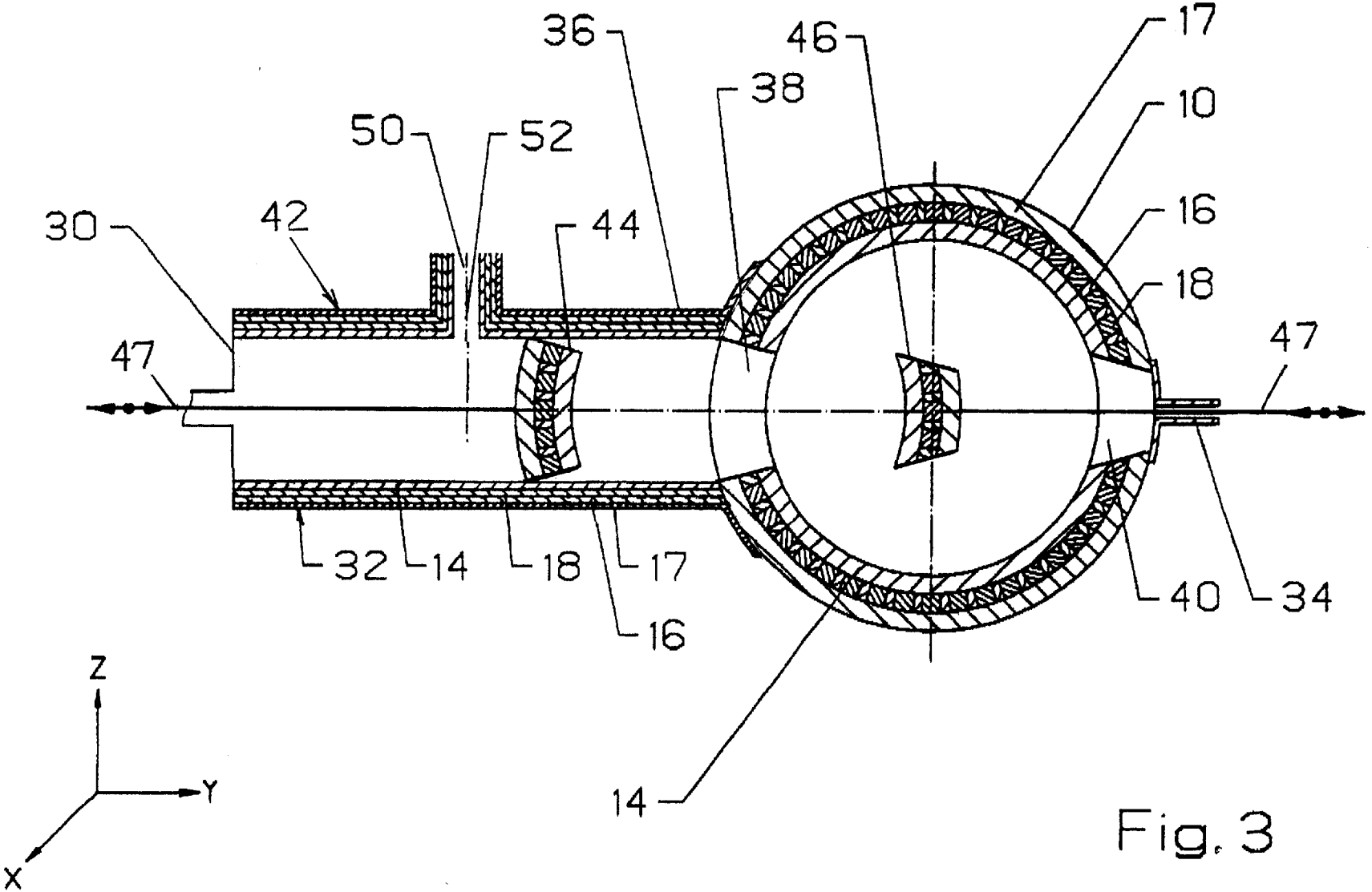
FIG. 3 shows an illustration, corresponding to FIG. 2, but with the closing pieces half inserted into the sphere.
Figure 4:
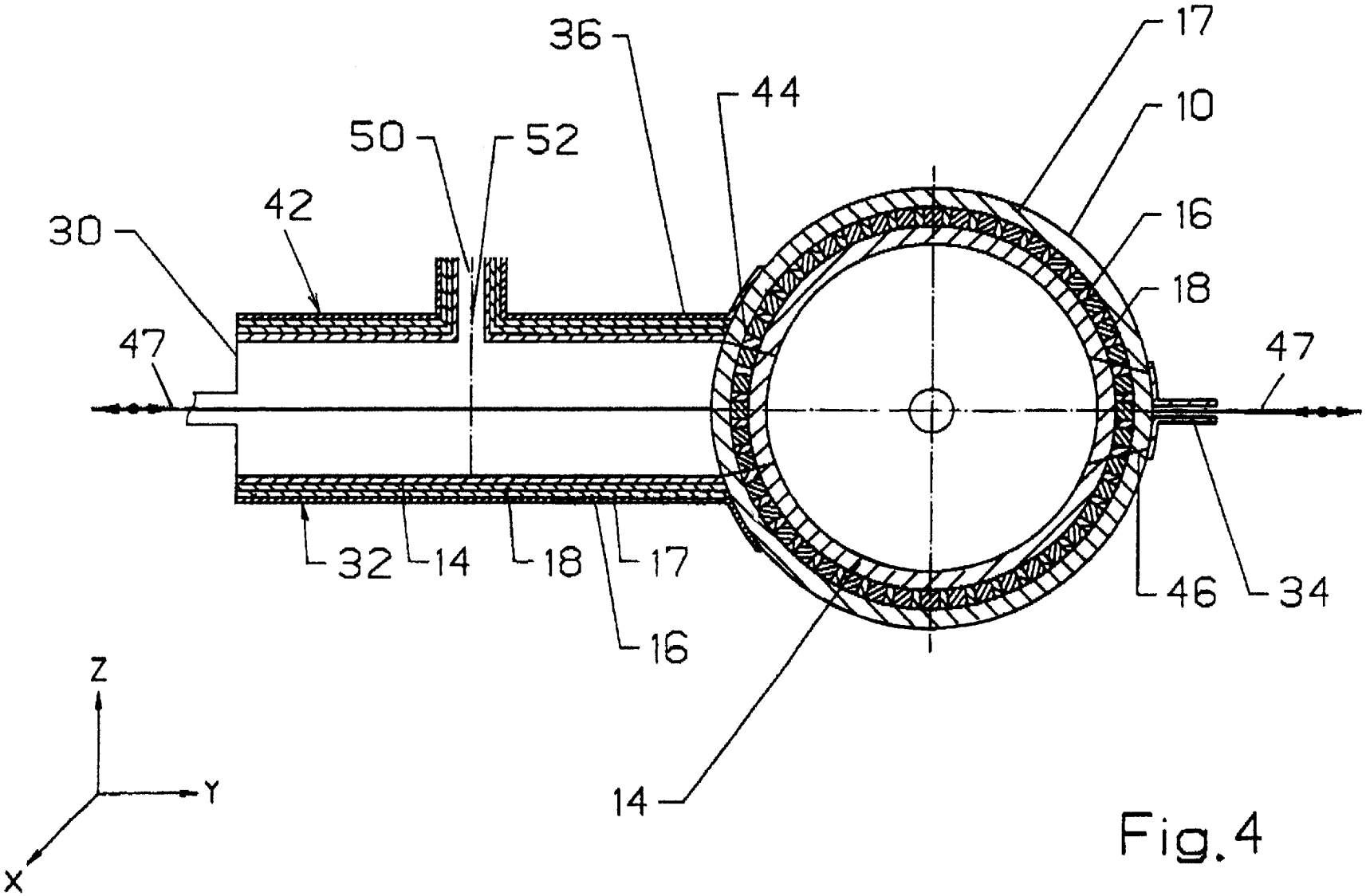
FIG. 4 shows an illustration corresponding to FIG. 3 in the closed position of the sphere.

The closing pieces are now guided, as described above, into the interior of the spherical container by means of the above-mentioned mechanical drive, which can likewise be matched to the respective location and application of the overall device. During this movement, there builds up between the two closing pieces 44 and 46 a magnetic field which has a gradient which is set precisely so fine that during this movement the anti-matter is always located at the midpoint between the two closing pieces. The fine tuning of the magnetic fields D and E is performed by a central controller which is computer-based and whose most important input parameters are the speed/time characteristic of the closing pieces, the mass of anti-matter obtained, and the distance of the closing pieces from one another. The position drawn in FIG. 3 is reached in this way in the course of the movement, and at the end of the movement it is the closed position reached in FIG. 4.

At the end of this movement, the magnetic field of the closing pieces D and E is controlled such that, the closer they come to their closed end position, the magnetic field strength approaches that field strength of the respectively neighboring spherical shell segments. This ensures that the anti-matter passes safely into the interior of the sphere. As described above, they are then located there in a position of equilibrium which can be maintained by exact open-loop control of the magnetic fields of the individual magnet segments.

The maintenance of the anti-matter in the center of the spherical container 10 can advantageously be performed by closed-loop control by means of a closed control loop in addition to open-loop control. The feedback signal required for feeding the positional information back into the control loop can be generated using the most varied sensors.

By virtue of the fact that the individual magnets which are contained in the spherical shell segments 18 can be set individually in terms of the strength of their magnetic field, it is possible for the magnetic field to be strengthened or weakened in one or other direction. Consequently, to the extent that it can be attracted by magnetic forces, the anti-matter moves in the interior of the spherical container 10. When dimensioning the size of the individual magnets in the spherical shell segments 18, it should be ensured that the temporal inertia of changes in magnetic field which the individual magnets experience for the purpose of the closed-loop control is as low as possible, in order to achieve efficient closed-loop control.

For example, one or more light beams could be interrupted by the anti-matter when the latter is located in the center of the spherical container. The state of the interrupted light beams could then be converted into a signal which, within certain, prescribed tolerances, signals correct positioning of the anti-matter with reference to a plane in space. A repetition of the same principle for various other planes in space thus permits three-dimensional closed-loop control of the storage location of the anti-matter in the spherical container 10.

Figure 5:
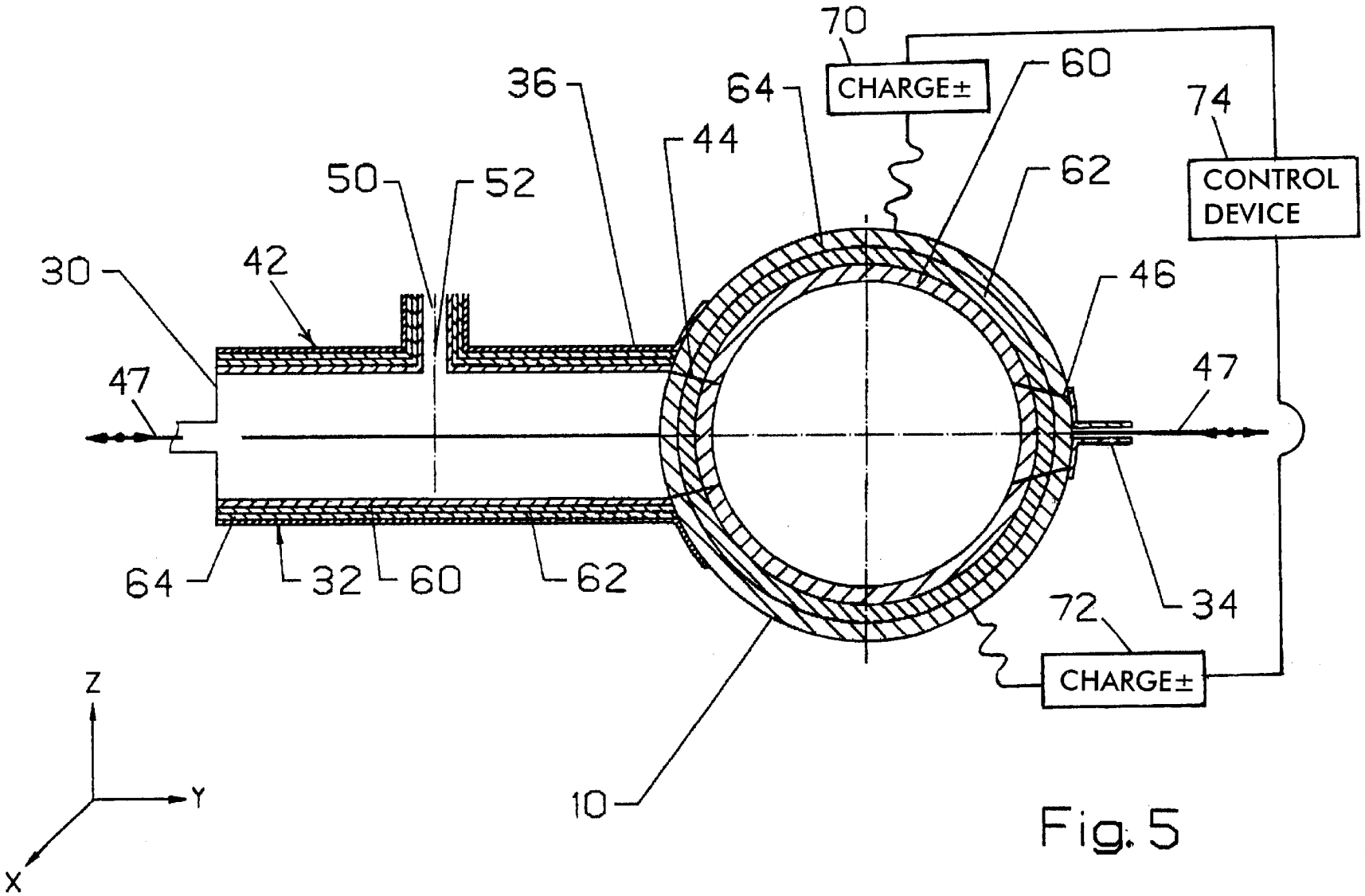
FIG. 5 shows an illustration corresponding to FIG. 2 in the closed position of the sphere, in an embodiment in which the force field is an electrostatic field in the interior of the sphere.

With reference to FIG. 5, a description is given below of a further, preferred exemplary embodiment of the anti-matter storage device according to the invention which can be applied whenever the anti-matter is electrically charged. In this case, the same reference symbols denote the same parts as in FIGS. 2, 3 and 4.

In a departure from the above-described exemplary embodiment, the shell of the spherical container 10 is now designed in principle as a spherical capacitor. Consequently, the materials of the individual layers of the layer-type composition of the spherical container must be matched in terms of the material.

An embodiment of the spherical container which is suitable for negatively charged anti-matter is described below. It can be altered for anti-matter with opposite charge by appropriate modification.

The negatively charged anti-matter can be produced, in principle, by bombardment with electrons which, for their part, utilize the valence positrons of the respective molecules.

The shell, designed as a spherical capacitor, of the spherical container 10 comprises the three electrically required layers, specifically an inner capacitor spherical shell 60, which is negatively charged, a dielectric 62 and-an outer capacitor spherical shell 64 which is positively charged. These electrically active shells are preferably arranged concentrically. The shells are arranged secured against mutual rotation with the aid of anti-rotation means such as have already been explained in principle in the preceding exemplary embodiment. The anti-rotation means are not permitted to conduct any electric current.

Electric charge is provided to outer shell 64 by a charging circuit 70 of any suitable or desired construction. Charging circuit 70 is controlled by a control device 74. A second charging circuit 72 may also be provided so that charge can be distributed separately and selectively transported to either of the upper one and a lower hemisphere of shell 64.

The layer thickness, the distance and the materials must be selected as a function of the strength of electric field which is to be built up in the interior of the sphere. Once the anti-matter is centered in the interior of the spherical container, it is repelled uniformly from all sides, since the charges of anti-matter and of the inner spherical wall are equal. In the present case, both are negatively charged.

It is thereby possible to dispense with complicated closed-loop control of the position of the anti-matter, since the anti-matter automatically takes up position in the center of the interior of the sphere, since in the absence of a gravitational field, producing a weight of the anti-matter, this site is the site of lowest potential energy.

This site is displaced in the direction of the gravitational field when such a field is present. The closed-loop control of the electric field strength of the electrostatic field is therefore performed in a preferred way such that the weight of the anti-matter is compensated in an appropriate way by the strength of the electric field so that the matter does not come into contact with the wall. If the storage device is fixed at a set orientation relative to the direction of the gravitational field, the spherical shell and, similarly, a half-cylinder shell can generate a larger repulsive force than the respective other one. For this purpose, the half shells are then isolated electrically from one another and can be electrically charged using separate control circuits.

The anti-matter can now in principle be conveyed into the sphere, or out of it, in the same way as was explained in the preceding exemplary embodiment.

In the present case, the inner wall of the introduction channel 50 is likewise negatively charged, in order to prevent the negatively charged anti-matter from coming into contact with its walls. The inner wall of the cylindrical attachment 42, and the inner walls of the closing pieces 44 and 46, are also negatively charged for the same reason. The gradient of the electric field, which is required for the purpose of introducing the anti-matter in this exemplary embodiment, can be instituted by a weakening of the repulsive electric field which is generated in the closing piece 46. Likewise, a strengthening of the electric field in the closing piece 44 can be instituted. It is also possible to combine both these measures.

The inner capacitor spherical shell consists of metal it the present exemplary embodiment. The dielectric intermediate shell expediently consists of a material which is best suited to the application and location as well as to the physical conditions occurring there such as temperature, pressure etc. The outer capacitor shell likewise consists of metal.

In principle, the two closing pieces 44 and 46 have the same capacitor design as the remainder of the spherical shell. The open-loop control of the electric field in the interior of the sphere can be instituted from outside by appropriate supply leads.

In a modification of-the last-described exemplary embodiment, it is also possible to dispense with the outer, positively charged layer, since it is, after all, only the radially inwardly directed, electrostatic field generated by the inner spherical shell which is relevant for stable storage of the anti-matter.

The emptying operation can be implemented by correspondingly reversing the steps required for filling.

Although the present invention was described above with the aid of a preferred exemplary embodiment, it is not limited thereto, but can be modified in multifarious ways. All these modifications are to be covered by the scope of protection of the claims as these are specified below.

System for the Storage and Transportation of Anti-matter

LIST OF REFERENCE SYMBOLS

Spherical container
Inner layer
Second layer
Outer layer
Segments
Evacuation opening
Filling and emptying arrangement
Frame
Right-hand part of the frame
Left-hand part of the frame
First large opening
Second small opening
Cylindrical attachment
First closing piece
Frame rod
Second closing piece
Introduction channel
Introduction opening
Inner capacitor spherical shell
Dielectric
Outer capacitor spherical shell

What is claimed is:

1. A device for storage of anti-matter comprising:

an evacuable hollow body comprised of at least one inner shell adapted for generating in the hollow body a force field for permitting anti-matter to be kept within the hollow body without contact with the inner shell;

an opening into the hollow body through the shell for filling or emptying the body with anti-matter;

at least one moveable closure moveable into and out of the opening for selectively closing and opening the opening in the shell;

a second opening in the inner shell, the first-mentioned opening and the second opening being located at radially opposite regions of the inner shell;

a second closure, the first-mentioned closure and the second closure shaped for engaging in and closing the first and second openings and being operable for selectively opening and closing the first and second openings;

a rod extending through the geometric center of the of the hollow body on which the first and second closures are supported, and the rod being movable for moving the closures together into and out of the first and second openings.

2. The device of claim 1, wherein an introduction channel comprises an evacuable inner space bounded by channel walls and communicating into the hollow body, the introduction channel and the evacuable inner space in the channel being set up for generating a force field directed so that the anti-matter can be kept in the inner region of the introduction channel without contacting the channel walls.

3. The device of claim 2, wherein:

the closure is so shaped, and is moveable so as to be received at least partially into the interior of the introduction channel; and the closure is adapted such that movement thereof into the interior of the hollow body guides the anti-matter into the hollow body.

4. The device of claim 3, further comprising:

a second opening in the inner shell, the first-mentioned opening and the second opening being located at radially opposite regions of the inner shell;

a second closure, the first -mentioned closure and the second closure being shaped for engaging in and closing the first and second openings and being operable for selectively opening and closing the first and second openings; and an entrance into the introduction channel for anti-matter, the first and second closure members being so spaced apart and the entrance being so placed in the channel that the first and second closures can bracket the sides of the entrance when in the channel and bound the inner space with anti-matter therein, the closure and the channel being adapted to move anti-matter into the hollow body as the closing closures move to the hollow body.

5. The device of claim 3, further comprising a plurality of the openings and a respective plurality of the closures for the openings, a support structure for supporting the closures at a constant distance from one another and for moving the closures into and out of the introduction channel and openings in the shell.

6. A device for storage of anti-matter comprising:

an evacuable hollow body including:

a confinement structure for anti-matter located within the hollow body, the confinement structure having an opening therein;

a passage into the hollow body positioned for communication with an interior portion of the confinement structure through the opening;

a closure moveable into and out of the opening for selectively blocking communication with the interior portion of the confinement structure;

a source of power operable to energize the confinement structure to generate a single type of inwardly directed force field that prevents anti-matter within the interior portion of the confinement structure from coming into contact therewith; and wherein the confinement structure is a spherical capacitor and the source of power is operative to generate a controllable electrostatic field.

7. A device for storage of anti-matter comprising:

an evacuable hollow body including:

a confinement structure for anti-matter located within the hollow body, the confinement structure having an opening therein;

a passage into the hollow body positioned for communication with an interior portion of the confinement structure through the opening;

a closure moveable into and out of the opening for selectively blocking communication with the interior portion of the confinement structure;

a source of power operable to energize the confinement structure to generate a single type of inwardly directed force field that prevents anti-matter within the interior portion of the confinement structure from coming into contact therewith;

a second opening in the confinement structure, the second opening being located at a radially opposite region of the confinement structure from the first-mentioned opening;

a second passage into the hollow body positioned for communication with the interior of the confinement structure through the second opening;

a second closure moveable into and out of the second opening, the first-mentioned closure and the second closure being shaped to seal the first and second openings;

wherein the closures are energizable by the power source to generate a portion of the force field.

8. A device for storage of anti-matter comprising:

an evacuable hollow body including:

a confinement structure for anti-matter located within the hollow body, the confinement structure having an opening therein;

a passage into the hollow body positioned for communication with an interior portion of the confinement structure through the opening;

a closure moveable into and out of the opening for selectively blocking communication with the interior portion of the confinement structure;

a source of power operable to energize the confinement structure to generate a single type of inwardly directed force field that prevents anti-matter within the interior portion of the confinement structure from coming into contact therewith;

a second opening in the confinement structure, the second opening being located at a radially opposite region of the confinement structure from the first-mentioned opening;

a second passage into the hollow body positioned for communication with the interior of the confinement structure through the second opening;

a second closure moveable into and out of the second opening, the first-mentioned closure and the second closure being shaped to seal the first and second openings;

wherein the first and second closures respectively seal the first passage and the first opening, and the second passage and the second opening; and an elongated rod extending through the geometric center of the of the hollow body that supports the first and second closures the rod being operable to move the closures together into and out of the first and second openings.

9. A device for storage of anti-matter comprising:

an evacuable hollow body including:

a confinement structure for anti-matter located within the hollow body, the confinement structure having an opening therein;

a passage into the hollow body positioned for communication with an interior portion of the confinement structure through the opening;

a closure moveable into and out of the opening for selectively blocking communication with the interior portion of the confinement structure;

a source of power operable to energize the confinement structure to generate a single type of inwardly directed force field that prevents anti-matter within the interior portion of the confinement structure from coming into contact therewith;

an introduction channel that communicates with the passage into the hollow body for introducing anti-matter into the confinement structure;

the introduction channel comprises an evacuable inner space bounded by channel walls and communicating into the hollow body; and the introduction channel and the evacuable inner space in the channel being operative to generate a force field directed so that the anti-matter can be kept in the inner region of the introduction channel without contacting the channel walls.

10. The device of claim 9, wherein:

the closure is so shaped and is moveable as to be received at least partially into the interior of the introduction channel; and the closure is energizable by the source to generate a force field that guides the anti-matter into the hollow body upon movement thereof into the interior of the hollow body.

11. The device of claims, further comprising:

a second opening in the inner shell, the first-mentioned opening and the second opening being located at radially opposite regions of the confinement structure;

a second closure, the first-mentioned closure and the second closure being respectively shaped to engage in and close the first and second openings; and an entrance into the introduction channel for anti-matter; and wherein:

the first and second closures are so spaced apart and the entrance is so placed in the channel that the first and second closing pieces can bracket the sides of the entrance when in the channel and bound the inner space with anti-matter therein; and the closures and the channel are operative to move anti-matter into the confinement structure as the closures move.

12. The device of claim 10, further comprising a plurality of the openings and a respective plurality of the closures for the openings, a support structure that supports the closures at a constant distance from one another and moves the closures into and out of the introduction channel and the openings in the confinement structure.

* * * * *